US006318363B1

(12) United States Patent
Monnich

(10) Patent No.: US 6,318,363 B1
(45) Date of Patent: Nov. 20, 2001

(54) HYDRODYNAMIC AND ERGONOMIC SNORKEL

(76) Inventor: John M. Monnich, 5426 California St., San Francisco, CA (US) 94118

( * ) Notice: Subject to any disclaimer, the term of this patent is extended or adjusted under 35 U.S.C. 154(b) by 0 days.

(21) Appl. No.: 09/229,193

(22) Filed: Jan. 13, 1999

Related U.S. Application Data

(60) Provisional application No. 60/071,338, filed on Jan. 14, 1998.

(51) Int. Cl.[7] ..... B63C 11/16

(52) U.S. Cl. ..... 128/201.11; 128/201.28

(58) Field of Search ..... 128/201.27, 201.28, 128/201.11, 204.26

(56) References Cited

U.S. PATENT DOCUMENTS

| | | | | |
|---|---|---|---|---|
| D. 328,959 | | 8/1992 | Greatrake et al. | D29/7 |
| D. 335,322 | | 5/1993 | Jones | D21/236 |
| D. 339,399 | | 9/1993 | Lin | D21/236 |
| D. 339,400 | | 9/1993 | Lin | D21/236 |
| 3,218,607 | * | 11/1965 | Brock et al. | 128/201.19 |
| 3,268,854 | * | 8/1966 | Sato | 128/201.19 |
| 3,292,618 | * | 12/1966 | Davis et al. | 128/201.11 |
| 3,451,039 | * | 6/1969 | Epstein et al. | 128/201.27 |
| 3,603,306 | * | 9/1971 | Bonin, Jr. | 128/201.11 |
| 3,736,551 | * | 5/1973 | Hirsch | 128/201.27 |
| 3,789,353 | * | 1/1974 | Hunter et al. | 128/201.19 |
| 3,814,090 | * | 6/1974 | Hill | 128/201.11 |
| 3,860,042 | | 1/1975 | Green | 128/145 A |
| 4,039,999 | * | 8/1977 | Weston | 128/201.27 |
| 4,071,024 | | 1/1978 | Blanc | 128/145 A |
| 4,230,106 | | 10/1980 | Geeslin et al. | 128/201.11 |
| 4,269,182 | * | 5/1981 | Le | 128/201.19 |
| 4,276,623 | * | 6/1981 | Abbott | 128/201.27 |
| 4,278,080 | | 7/1981 | Schuch | 128/201.11 |
| 4,380,232 | | 4/1983 | Doyle | 128/201.11 |
| 4,610,246 | | 9/1986 | Delphia | 128/201.11 |
| 4,655,212 | | 4/1987 | Delphia | 128/201.11 |
| 4,708,135 | | 11/1987 | Arkema | 128/201.11 |
| 4,782,830 | | 11/1988 | Forman | 128/201.11 |
| 4,799,263 | * | 1/1989 | Banzinger et al. | 128/201.27 |
| 4,805,610 | | 2/1989 | Hunt | 128/201.11 |
| 4,834,084 | | 5/1989 | Walsh | 128/201.11 |
| 4,877,022 | | 10/1989 | Christianson | 128/201.11 |
| 4,878,491 | * | 11/1989 | McGilvray, III | 128/201.11 |

(List continued on next page.)

FOREIGN PATENT DOCUMENTS

| | | | | |
|---|---|---|---|---|
| WO 91/17916 | * | 11/1991 | (WO) | 128/201.11 |

OTHER PUBLICATIONS

Advertisement, "2100 Ball, Check, Gate & Port Valves", Ewing Irrigation Products, Phoenix, Arizona, pp. 66.

Finis, Inc., "Fin Swimming for Recreation, Fitness, Swimming Development and Compeitions—The Swimmer's Snorkel" Internet Web Site Page http://www.finis–net.com/snorkel.htm.

*Primary Examiner*—Aaron J. Lewis
(74) *Attorney, Agent, or Firm*—Stallman & Pollock LLP

(57) ABSTRACT

A snorkel is designed for swimming is shaped to offer a minimum of drag to permit the user to expend less energy while moving with greater speed through the water. The lower portion of the snorkel is constructed from a flexible internal skeleton/external shell which enables the breathing tube to closely conform to the head of the swimmer, eliminating gaps that give rise to turbulence and drag. The snorkel also features a cross-sectional profile that minimizes water resistance. The lower portion of the snorkel is in the shape of a half circle, with the straight edge facing the user and the circular edge facing outward and offering a streamlined profile to the water. The upper half of the snorkel is in the shape of an airfoil, with the tips pointing into and away from the direction of motion, thereby facilitating movement of the snorkel through the water.

19 Claims, 7 Drawing Sheets

U.S. PATENT DOCUMENTS

| | | | |
|---|---|---|---|
| 4,879,995 | 11/1989 | Christianson | 128/201.11 |
| 4,884,564 | 12/1989 | Lamont | 128/201.11 |
| 4,896,664 | 1/1990 | Harayama | 128/200.25 |
| 4,928,710 | 5/1990 | Campbell | 128/861 |
| 5,092,324 | 3/1992 | Christianson | 128/201.11 |
| 5,143,059 | 9/1992 | Delphia | 128/201.11 |
| 5,199,422 | 4/1993 | Rasocha | 128/201.11 |
| 5,239,990 | 8/1993 | Delphia | 128/201.11 |
| 5,261,396 | 11/1993 | Faulconer et al. | 128/201.11 |
| 5,267,556 | 12/1993 | Feng | 128/201.11 |
| 5,280,785 | 1/1994 | Fujima | 128/201.11 |
| 5,404,872 | 4/1995 | Choi | 128/201.11 |
| 5,438,977 * | 8/1995 | Gomez et al. | 128/201.27 |
| 5,487,379 * | 1/1996 | Koshiishi | 128/201.28 |
| 5,493,079 * | 2/1996 | Anderson | 128/201.11 |
| 5,529,057 | 6/1996 | Ferrero et al. | 128/201.11 |
| 5,657,746 | 8/1997 | Christianson | 128/201.11 |
| 5,664,558 | 9/1997 | Wagner | 128/201.11 |
| 5,671,728 | 9/1997 | Winefordner et al. | 128/201.11 |
| 5,697,362 | 12/1997 | Albrecht | 128/201.11 |
| 5,845,635 | 12/1998 | Ilermansen et al. | 128/201.11 |
| 5,865,169 | 2/1999 | Lan et al. | 128/201.11 |
| 5,868,129 | 2/1999 | Christianson | 128/201.11 |

* cited by examiner

HYDRODYNAMIC AND ERGONOMIC SNORKEL

CROSS-REFERENCE TO RELATED APPLICATION(S)

This non-provisional patent application claims priority from provisional patent application No. 60/071,338, filed Jan. 14, 1998 and entitled "HYDRODYNAMIC AND ERGONOMIC SNORKEL". This provisional patent application is hereby incorporated by reference.

BACKGROUND OF THE INVENTION

1. Field of the Invention

This invention relates generally to a water snorkel for swimming that has enhanced hydrodynamic and ergonomic properties. More specifically, the invention relates to a breathing tube having a flexible lower portion and a cross-sectional profile that allows it to conform to the face of the user and offer a minimum of resistance to the water.

2. Description of the Related Art

The use of a breathing tube to allow a swimmer to maintain facial position below the surface of the water is well known. Snorkels are useful in clear water to allow observation of underwater plant and animal life. Snorkels can also be used to allow movement with greater speed and efficiency through the water.

A swimmer will stroke with ideal efficiency when his or her face is in the water, but the back of the head remains out of the water. Many swimmers find breathing difficult while maintaining ideal stroke form, as pushing the chin forward to lift the back of the head out of the water creates a strain in the trachea.

Moreover, when a swimmer raises his or her head to breathe, the hips and legs sink into the water. A two-inch vertical lift of the head can result in a four- to six-inch drop of the hips, and a corresponding eight- to twelve-inch drop of the feet. This departure from ideal stroke form can double the frontal surface area offered to the water, thereby doubling the water resistance encountered by the swimmer.

Because a snorkel allows the swimmer to breathe without raising his or her head, snorkels have been used to assist athletes train for competition. One example of a snorkel designed for swimmers is the "Finis Center Mount Swimmer's Snorkel" (hereafter "the Finis snorkel") manufactured by Finis, Inc. of Tracy, Calif.

FIG. 1 illustrates a profile view of the Finis snorkel. The Finis snorkel 100 includes a breathing tube 102 that extends out from the mouth and includes an upper portion 104 which extends upward at the center of the face between the eyes of the user, with open end 106 ultimately projecting above the surface of the water. Breathing tube 102 also includes a downward portion 108 housing a water reservoir 110 and a purge valve 112.

While the Finis snorkel is useful for training, it suffers from a number of disadvantages.

First, purge valve 112 is a traditional design used for diving. In order to activate conventional diving purge valve 112, reservoir 110 must be filled with water above the mouth area. When the user sharply exhales, water in the snorkel is forced upward, and provides sufficient back pressure to offset external water pressure and activate the purge valve. Accumulated air and water are expunged, and the swimmer can breathe again.

When a snorkel is used by a scuba diver, water normally fills the entire snorkel and the conventional purge valve works adequately. However, when a snorkel is used primarily for surface activities such as swimming and snorkeling, the snorkel will contain some water but will not ordinarily become filled.

The conventional diving-type purge valve of the Finis snorkel is thus unsuited for swimming and snorkeling, as a relatively large volume of water must accumulate in the snorkel before it can be purged. This accumulated water consumes valuable air space, decreasing the flow of air available to the swimmer. Accumulated water can also splash into the swimmer's airway, making breathing uncomfortable.

A second disadvantage of the Finis snorkel is that the cross-section of breathing tube 102 is designed to be as narrow as possible. The narrowness of breathing tube 102 is intended to offer minimum resistance while the user's face is underwater, and also to force the user to breathe harder and thereby enhance aerobic activity during training.

However, in applications such as open water swimming or snorkeling, safety rather than fitness is of paramount concern and a narrow breathing tube could interfere with necessary and proper breathing. Moreover, use of a narrow breathing tube does not necessarily ensure that water resistance will be kept to a minimum.

A third disadvantage of the Finis snorkel is the manner in which it is worn. The Finis snorkel is held to the forehead by thick plastic headband 114. Headband 114 must be worn tight around the head, and is made of solid plastic to ensure secure attachment. Headband 114 may exert an uncomfortable pressure upon the swimmer's brow.

Moreover, in order to don the snorkel, the user must turn mouthpiece 116 to one side and then slide headband 114 down over the forehead, finally turning mouthpiece 116 back to fit within the mouth. Furthermore, headband 114 does not have a release clip, making it difficult to remove the snorkel.

A fourth disadvantage of the Finis snorkel is that open end 106 of breathing tube 102 projects substantially vertically above the water surface. This shape permits water to enter the snorkel via splashing from the swimmer or those nearby.

A fifth disadvantage of the Finis snorkel is that upper portion 104 of breathing tube 102 is located in front of the face and between the eyes of the user. This positioning interferes with the swimmer's line of vision of the swimmer, conveying the unpleasant sensation of being cross-eyed.

A sixth disadvantage of the Finis snorkel is that breathing tube 102 is fixed by headband 114 at a distance from the face of the user. Gap 118 between the swimmer's head and the breathing tube contributes turbulence and drag to movement of the snorkel through the water, and also permits the snorkel to move from side-to-side in response to resistance offered by the water. This "wavering" of the snorkel is distracting to the user, and also creates additional water resistance to impede movement of the swimmer through the water.

Given the above-listed disadvantages, there is a need in the art for a snorkel design that permits a swimmer to efficiently move through the water with a minimum of drag and a maximum of comfort.

SUMMARY OF THE INVENTION

The present application relates to a snorkel which includes a number of features that reduce the frictional resistance as the snorkel passes through the water. The lower portion of the snorkel in accordance with the present invention is flexible and may be shaped to conform to the face of the swimmer, thereby eliminating drag attributable to the gap between the snorkel and swimmer's head.

The snorkel design in accordance with the present invention also includes a cross-sectional profile specifically intended to reduce water resistance. Specifically, the cross-section of the lower portion of the snorkel is in the shape of a half-circle, such that the flat edge faces the swimmer and the round edge faces the water. The lower half of the snorkel thus offers less resistance to water displaced by the swimmer, which flows easily around the rounded facing edge of the snorkel.

The cross-section of the upper half of the snorkel is in the shape of an airfoil. The tips of this airfoil face into and away from the direction of movement, offering less resistance as the snorkel moves through the water.

A snorkel in accordance with one embodiment of the present invention comprises a lower breathing tube portion having a half-circular cross-section including a straight edge and a curved edge, the lower portion including a mouthpiece positioned in front of the straight edge and open to a breathing chamber and a purge valve permitting one-way flow of air and water out of the airway, and an upper breathing tube portion joined to a lower portion at a junction, the upper portion having an airfoil cross-section including a leading corner and a trailing corner, the upper portion including a check valve operable from an inactivated state permitting free movement of air to an activated state preventing movement of air into and out of the check valve, the upper portion also including an upper opening.

The features and advantages of the present invention will be better understood upon consideration of the following detailed description of the invention and the accompanying drawings.

DETAILED DESCRIPTION

The present invention is a hydrodynamic and ergonomic snorkel design that facilitates swimming with the body in ideal stroke position, without requiring the swimmer to rotate his or her head out of the water in order to breathe. The snorkel is especially designed to be used at the water's surface, for activities such as swimming and snorkeling. As with a conventional snorkel, a hollow tube allows the head to reside in the water while it transports air from above the surface of the water to the mouth below.

Figure 1:
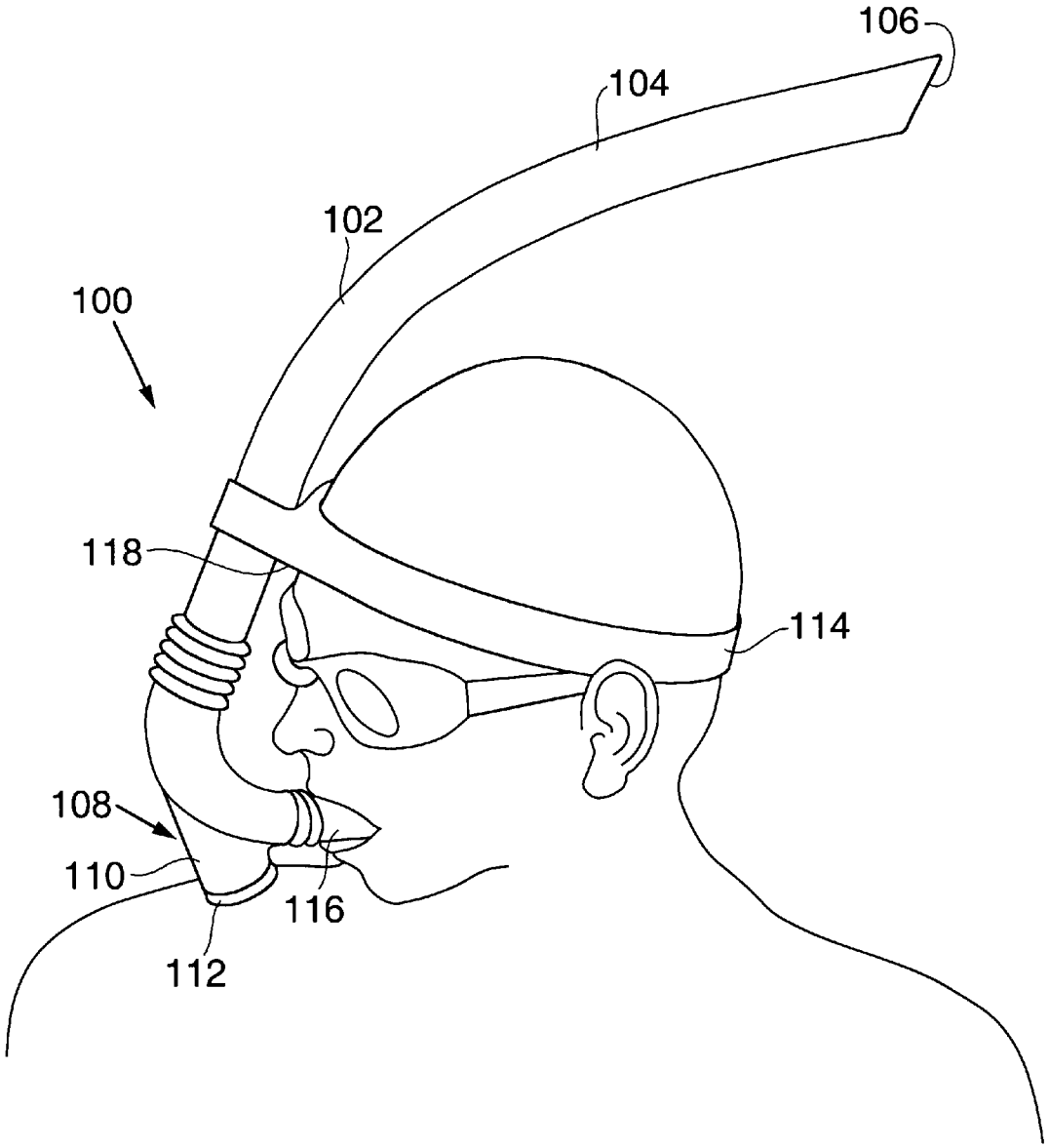
FIG. 1 (PRIOR ART)
FIG. 1 shows a perspective view of the Finis snorkel.
Figure 2:
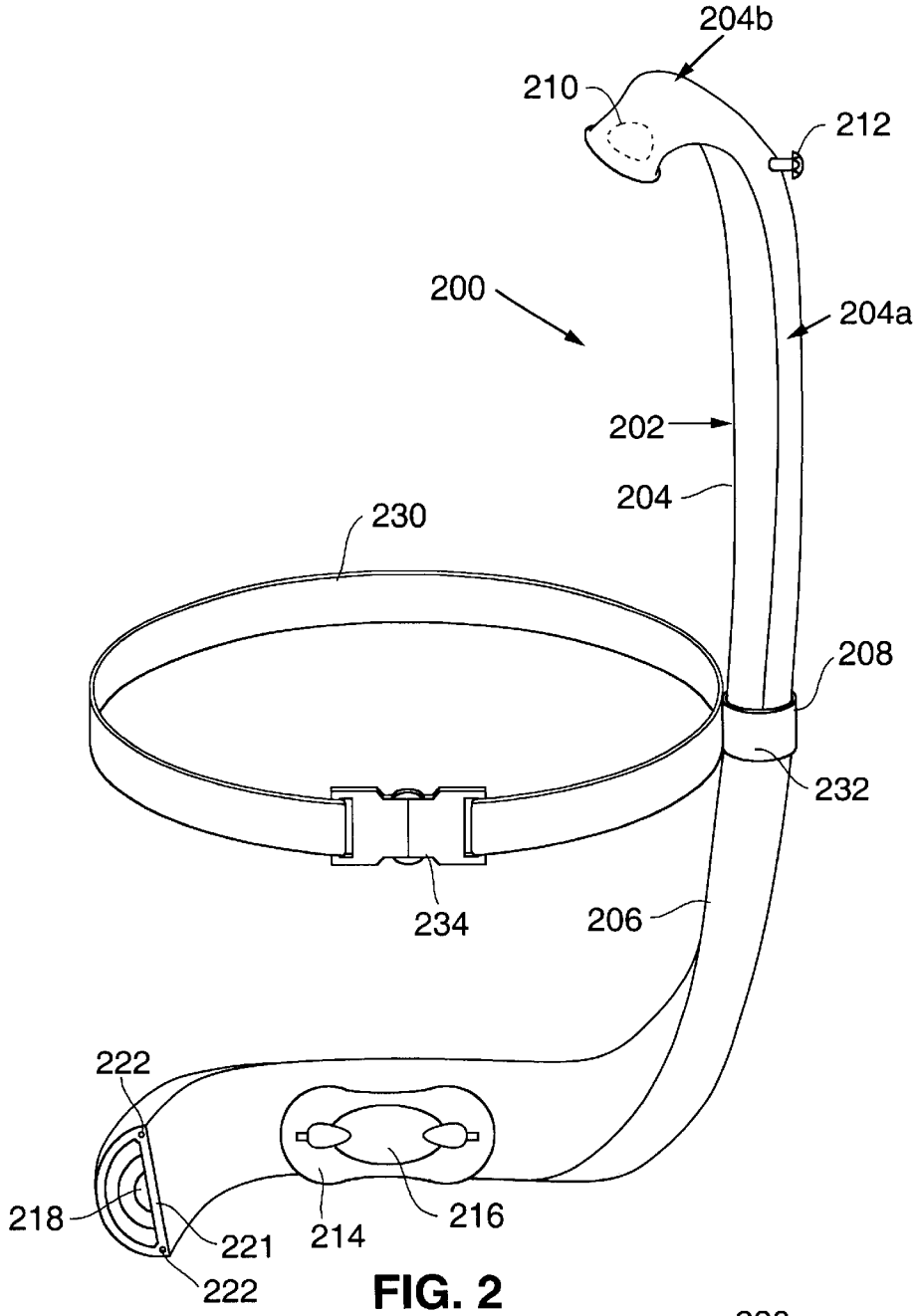
FIG. 2 shows a perspective view of a snorkel in accordance with a first embodiment of the present invention.

FIG. 2 shows a perspective view of a snorkel in accordance with a first embodiment of the present invention. Snorkel 200 includes a breathing tube 202 that includes an upper portion 204 and a lower portion 206 which meet at junction 208.

Upper portion 204 has an "airfoil" cross-sectional shape. Upper portion 204 is constructed from hard and stiff injection-molded plastic.

Upper portion 204 includes an internal check valve having adjustment screw 212 positioned at the end of straight segment 204*a* prior to arc segment 204*b*. Arc segment 204*b* changes direction 180° from straight segment 204*a*, such that the upper opening 210 positioned at the end of upper portion 204 faces lower portion 206. Opening 210 faces downward over the top of the swimmer's head. This orientation of upper opening 210 prevents water splashing over the top of the snorkel from entering through upper opening 210. However, upper opening 210 remains positioned far enough above the surface of the water to prevent the user from accidentally inhaling water.

Lower portion 206 of breathing tube 202 has a "half-circular" cross-sectional shape. Lower portion 206 includes a mouthpiece 214 positioned in front of a breathing chamber 216, and a recessed purge valve 218.

Lower portion 206 of breathing tube 202 is constructed from a soft plastic shell 221 of lightweight and flexible material such as polyurethane. Support wire 222 runs along the inside corners of shell 221 at opposite corners 228, lending additional support to lower portion 206. When necessary, a flexible mesh or a series of internal ribs may provide additional support for lower portion 206.

Because shell 221 and wire 222 are all composed of flexible materials, the shape of lower portion 206 can readily be adjusted to conform to the contour of the face of a particular user. Moreover, shell 221 can be fabricated utilizing a mold in the general shape of a face. Molds of various sizes can be utilized to model the faces of children, adolescents, and adults.

Snorkel 200 is secured to the head of a user by thin, adjustable rubber strap 230. Strap 230 includes a loop 232 enclosing junction 208. The ends of strap 230 are fitted to simple clasp 234, so that the user can release clasp 234 at the back of the head and pull the snorkel quickly and easily away from the face.

The strap, the hydrodynamic shape of the lower portion, and the conformity of the snorkel to the face each secure lower portion 206 in place against the head of the swimmer. This frees the swimmer from having to clamp his or her teeth down upon mouthpiece 214 in order to hold snorkel 200 in place. Instead, snorkel 200 rests comfortably in the mouth.

Figure 3A:
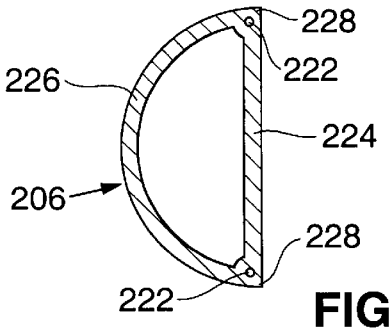
FIGS. 3A and 3B show cross-sectional views of the lower and upper portions of the snorkel shown in FIG. 2.
Figure 3B:
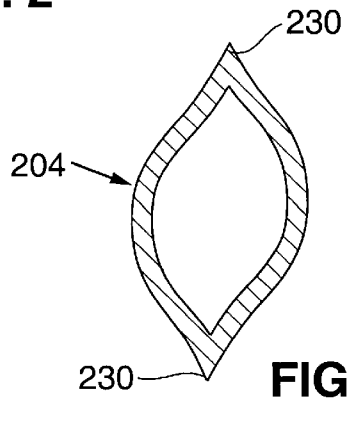

FIGS. 3A and 3B show cross-sectional views of the upper and lower portions of the snorkel. FIGS. 3A and 3B underscore that the snorkel possesses two distinct cross-sectional shapes. As shown in FIG. 3A, below junction 208 breathing tube 202 assumes a "half-circle" shape, having a straight edge 224 and rounded edge 226. Support wire 222 is runs along opposite corners 228 of this half-circle.

As shown in FIG. 3B, above junction 208 breathing tube 202 assumes an "airfoil" shape having leading and trailing corners 230. Upper portion 204 is formed from lightweight and hard injection molded plastic, and therefore does not require a support wire.

Figure 4A:
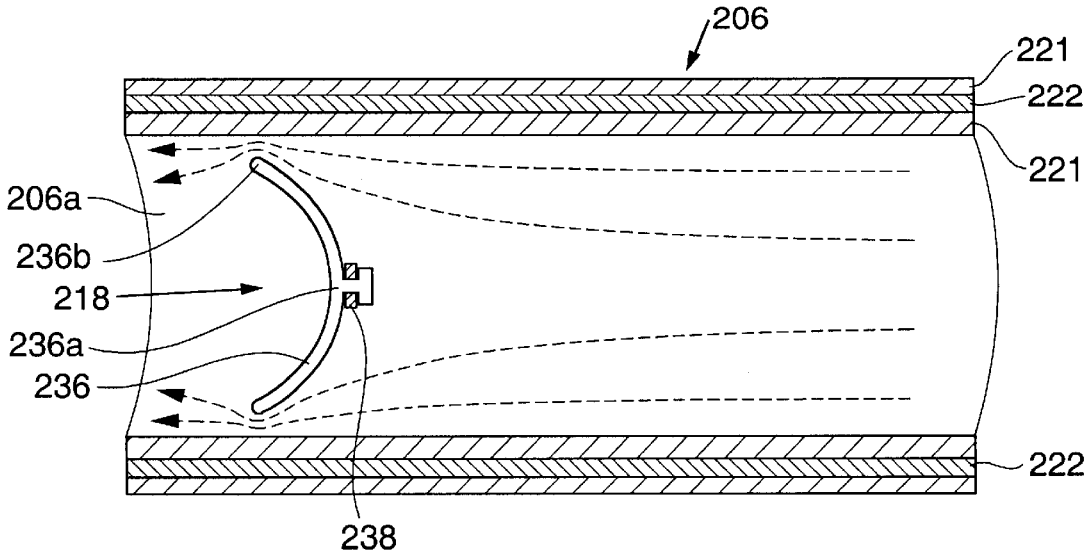
FIGS. 4A and 4B show cut-away views of the lower portion of the snorkel shown in FIG. 2.
Figure 4B:
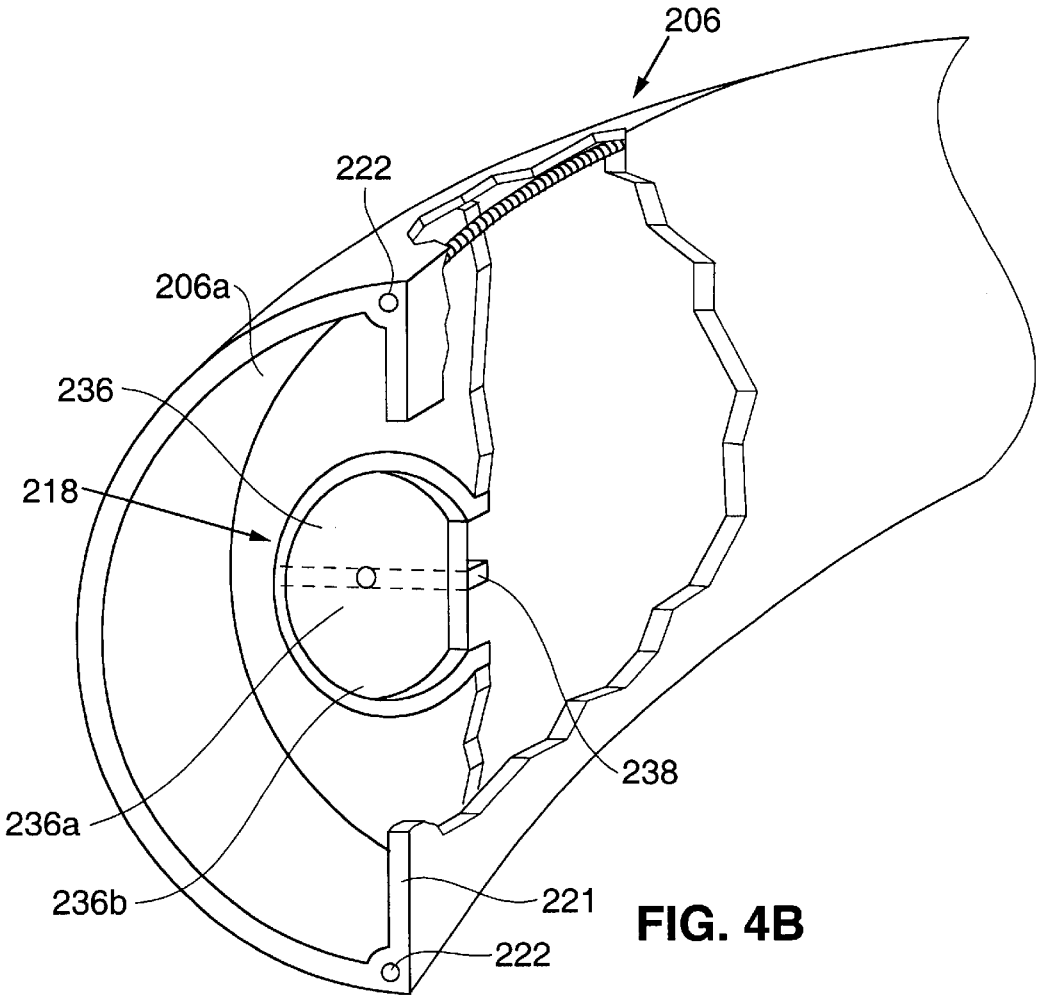

FIGS. 4A and 4B show different cut-away views of lower portion 206 of snorkel 200. Breathing tube 202 is capped by recessed purge valve 218. FIG. 4A shows recessed purge valve 218 as an umbrella valve, where center 236*a* of flap 236 is fixed to cross-member 238. Peripheral edges 236*b* of flap 236 are flexible away from center 236*a* and cross-member 238. When the user exhales with sufficient force to overcome the external pressure, recessed purge valve 218 permits the flow of air and water out of the snorkel.

However, recessed purge valve 218 precludes the reverse flow of water or air back into the snorkel.

FIG. 4B shows the position of purge valve 218 within lower portion 206. Purge valve 218 is recessed within lower portion 206, such that interior walls 206*a* shield flap 236 from being displaced by outside water movement. Purge valve 218 may also be removable from lower portion 206 to allow maintenance or replacement.

Figure 5:
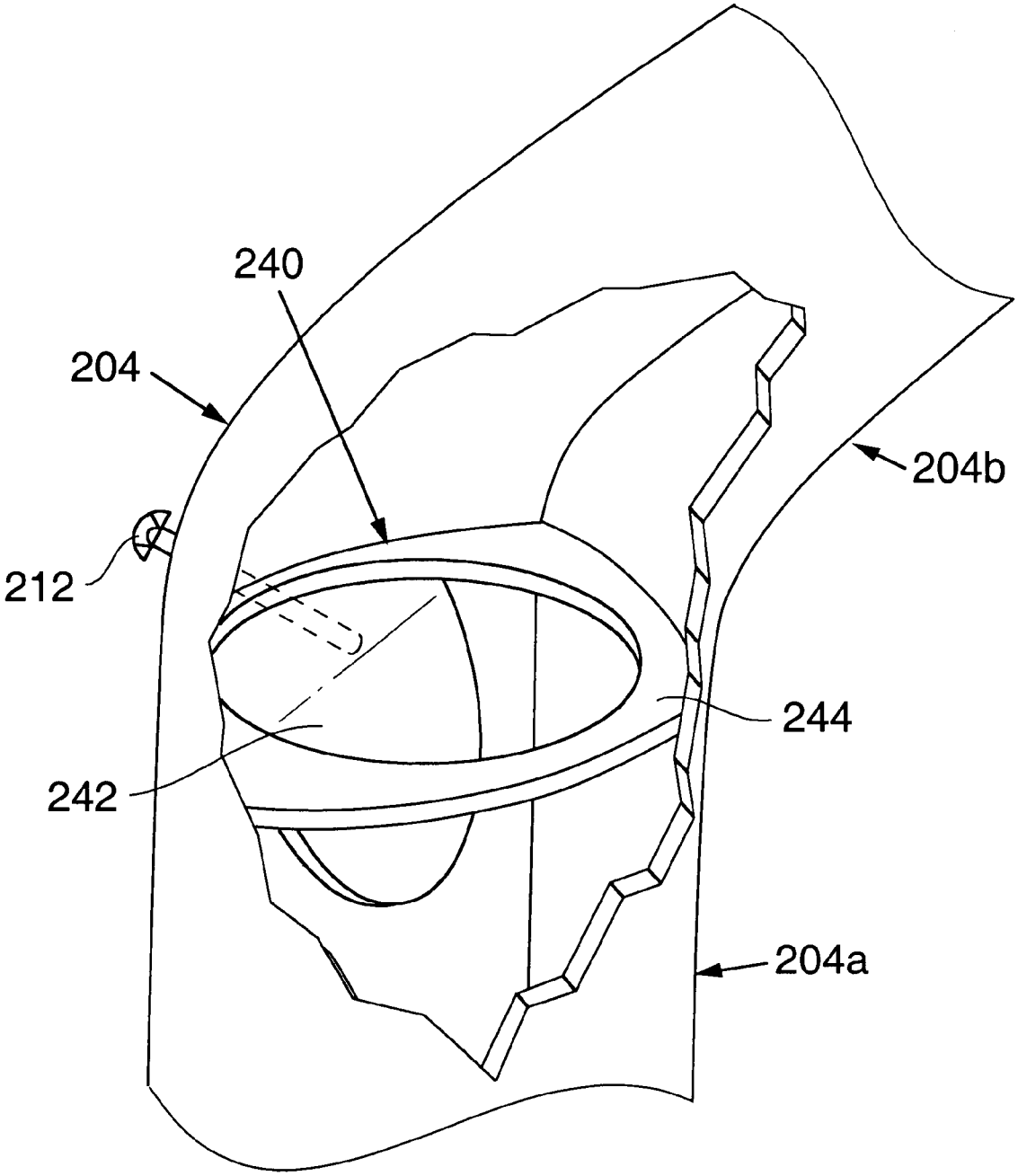
FIG. 5 shows a cut-away view of the upper portion of the snorkel shown in FIG. 2.

Returning to back to FIG. 2, upper portion 204 of breathing tube 202 includes a straight segment 204*a* located above junction 208. At the end of straight segment 204*a*, arc segment 204*b* turns approximately 180° and curves downward over the top of the swimmer's head. FIG. 5 shows a cut-away view of upper portion 204.

Internal check valve 240 is positioned at the top of straight segment 204*a*, before upper portion 204 makes its downward arc. Internal check valve 240 is a tension-controlled flap valve that allows the user to purge the air chamber at will. Flap 242 of internal check valve 240 is attached to the underside of valve lip 244 within the breathing tube. Check valve 240 is adapted from a design previously utilized for irrigation, specifically, the 1" King Swing Check, manufactured by King Brothers Industries of Valencia, Calif.

When check valve 240 is in an inactivated state, flap 242 hangs down freely, allowing air to pass in and out of valve 240 to the user's mouth below. When the user wishes to clear accumulated water, the swimmer rolls to the side in the normal course of swimming and sharply exhales.

This sharp exhalation causes flap 242 to swing upwards into its activated position against lip 244. This closes check valve 240, preventing the passage of air in either direction. Closing check valve 240 in turn creates an internal pressure within the snorkel that is greater than the external water pressure, allowing air and accumulated water to pass out of recessed purge valve 218.

Unlike the 1" King Swing Check valve, check valve 240 also includes an adjustable screw 212. Flap 242 is extended out into the airway of breathing tube 202 by adjustable screw 212. Screw 212 allows the user to control how far out into the airway flap 242 extends in the inactivated position, and thus the amount of pressure needed to close internal check valve 240.

For example, a swimmer moving at a fast speed in open water splashes a great deal more than a slower swimmer doing relaxed laps in a pool. The faster swimmer's movements cause larger amounts of water to enter the snorkel, and require that the snorkel be purged more frequently and easily. The faster swimmer will therefore adjust screw 212 to extend flap 242 out further into the airway, so that flap 242 is activated by less pressure. Conversely, the slower swimmer will adjust screw 218 to extend less further into the airway, so that occasional exhalation with greater force is necessary to activate check valve 240 and purge snorkel 200.

Figure 6:
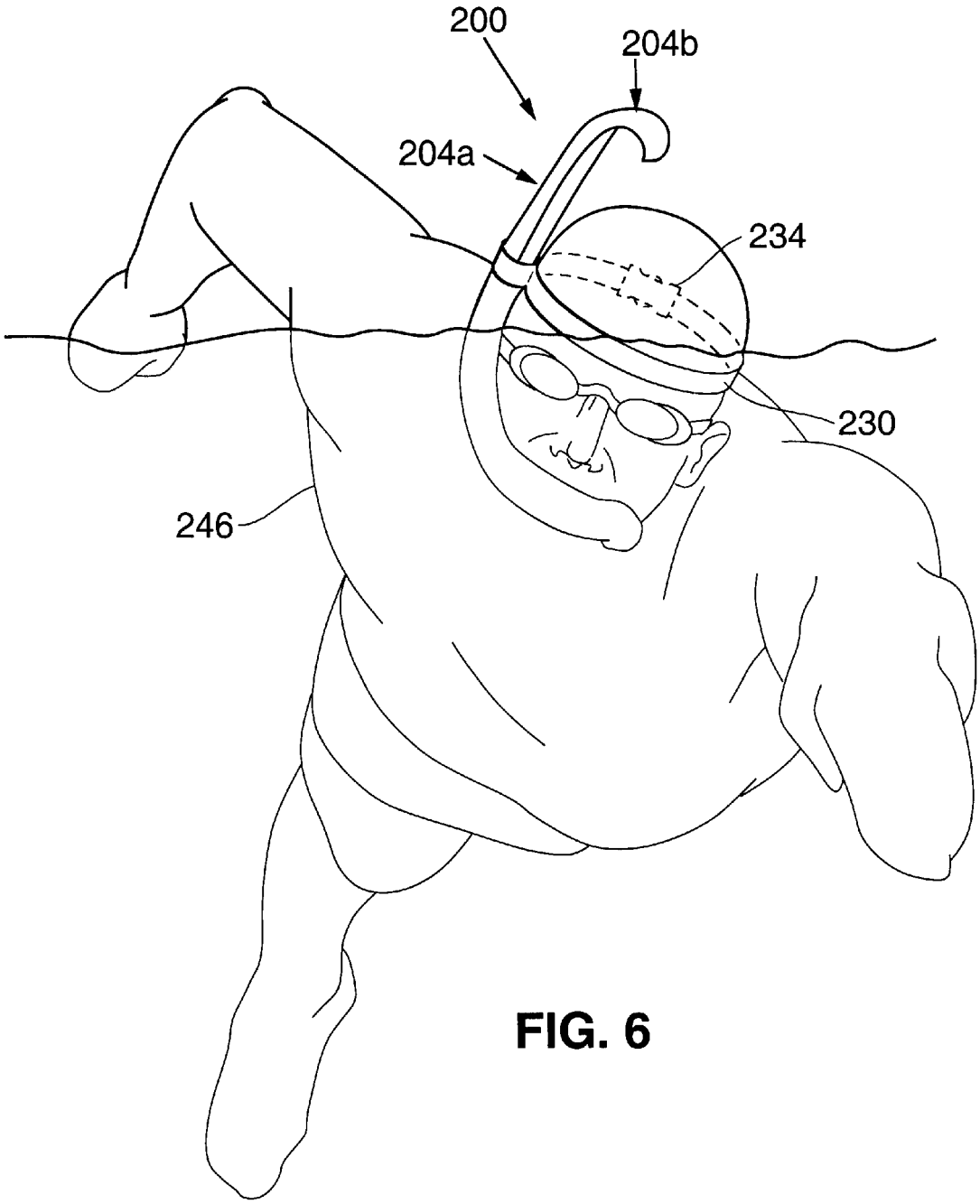
FIG. 6 shows a perspective view of the snorkel in use.

FIG. 6 shows a perspective view of snorkel 200 during the act of purging. Swimmer 246 has rolled such that the recessed purge valve occupies the lowest point of the snorkel. Accumulated water therefore flows to purge valve and is expelled from the snorkel by sharp exhalation. Moreover, in this position arc segment 204*b* of upper portion 204 lies above the upper opening, so that water trapped above the closed check valve may simply drain out of the upper opening.

FIG. 6 also reveals that strap 230 marks a line across the forehead that corresponds to "perfect head position" in the water. FIG. 6 further reveals the closeness with which snorkel 200 fits against the swimmer's face without interfering with his or her vision.

The present invention offers a number of important advantages over existing snorkel designs. In particular, a snorkel in accordance with the present invention offers a minimum of resistance to the water. This is because the lower portion of the snorkel is flexible, and can be shaped to conform to the curvature of the face of the user. Moreover, the half-circular cross-sectional profile of the lower portion of the snorkel allows it to lie flush against the face of the swimmer. Both of these features significantly reduce drag associated with turbulence generated by the gap between the face and the snorkel.

The snorkel in accordance with the present invention also offers the advantage of inhibiting the unwanted entry of water into the breathing tube. This is accomplished by orienting the upper opening of the snorkel to face the top of the swimmer's head.

The snorkel in accordance with the present invention further offers the advantage of convenience, as the clasp permits easy fitting or removal of the snorkel.

The snorkel in accordance with the present invention is also advantageous in that the upper portion of the snorkel is disposed to the side of the face of the swimmer. This preserves the line of sight of the user, and prevents the "cross-eyed" sensation that users may find distracting.

Although the invention has been described in connection with one specific preferred embodiment, it should be understood that the invention as claimed should not be unduly limited to such specific embodiments. Various other modifications and alterations in the structure and method of operation of the invention will be apparent to those skilled in the art, without departing from the scope of the present invention.

Figure 7A:
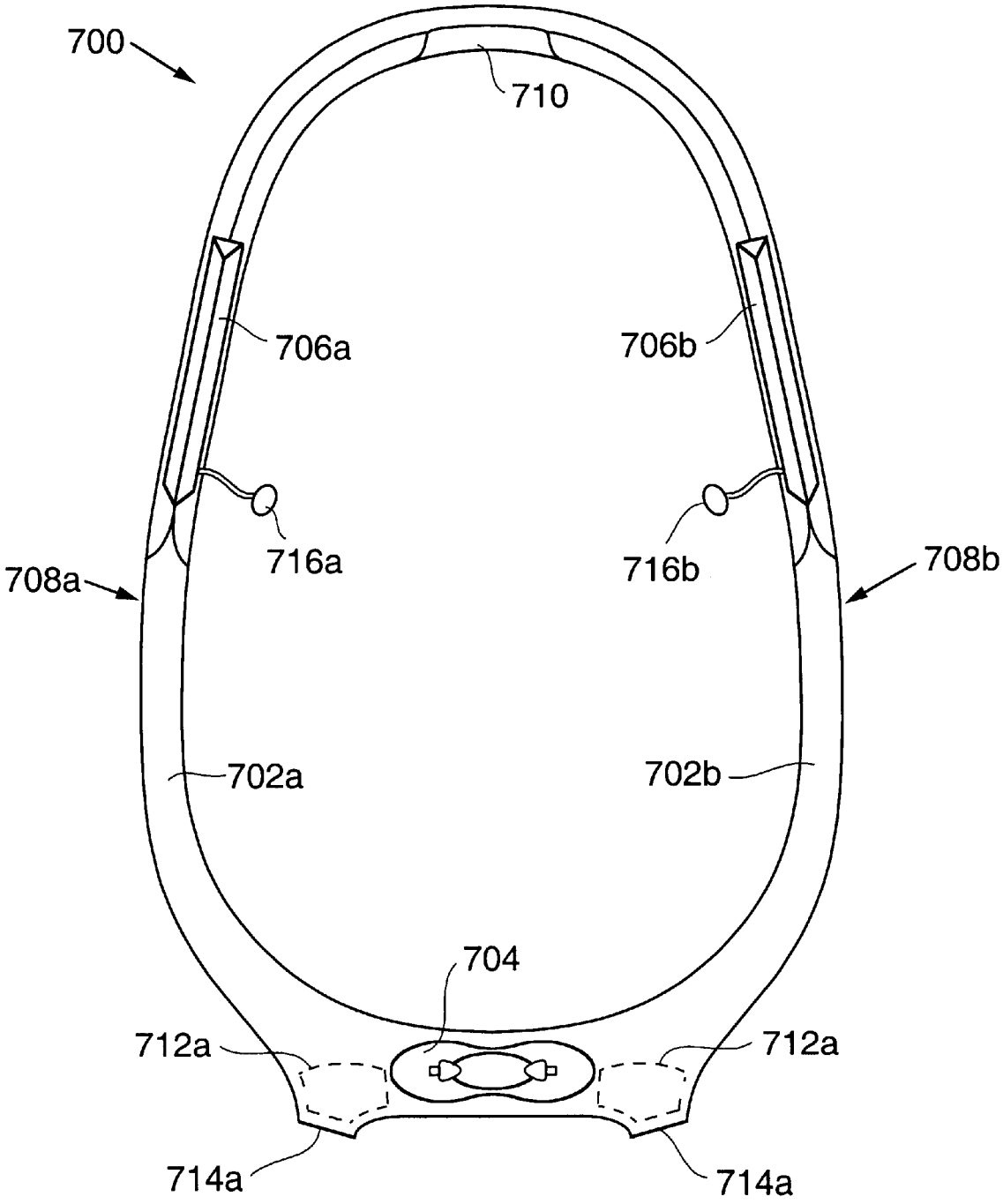
FIGS. 7A and 7B show perspective views of a second embodiment of the snorkel in accordance with the present invention.

For example, a second embodiment of the snorkel in accordance with the present invention is illustrated in FIG. 7A. FIG. 7A shows a rear view of snorkel 700, which includes two breathing tubes 720*a* and 720*b* positioned on either side of mouthpiece 704. Each breathing tube 720*a* and 720*b* has the cross-sectional profile of the breathing tube 202 described above in accordance with the first embodiment of the present invention, except that a waterproof radio 706*a* is positioned in a housing located immediately above junction 708*a* of breathing tube, 720*a*.

Breathing tubes 720*a* and 720*b* are joined at the top of the head to define upper opening 710. Upper opening 710 is oriented to the rear and opens downward over the head of the swimmer. Utilization of a snorkel design in accordance with this second embodiment allows greater air flow to the swimmer and enhanced structural stability for the snorkel.

Snorkel 700 also includes two drainage chambers 712*a* and 712*b*, each chamber including a separate purge valve 714*a* and 714*b*, respectively. This feature increases the volume of the drain chamber available to the swimmer, allowing the swimmer to swim for longer periods before having to purge collected water. This feature also directs excess water away from the swimmer's mouth as the swimmer inhales through the mouthpiece.

Figure 7B:
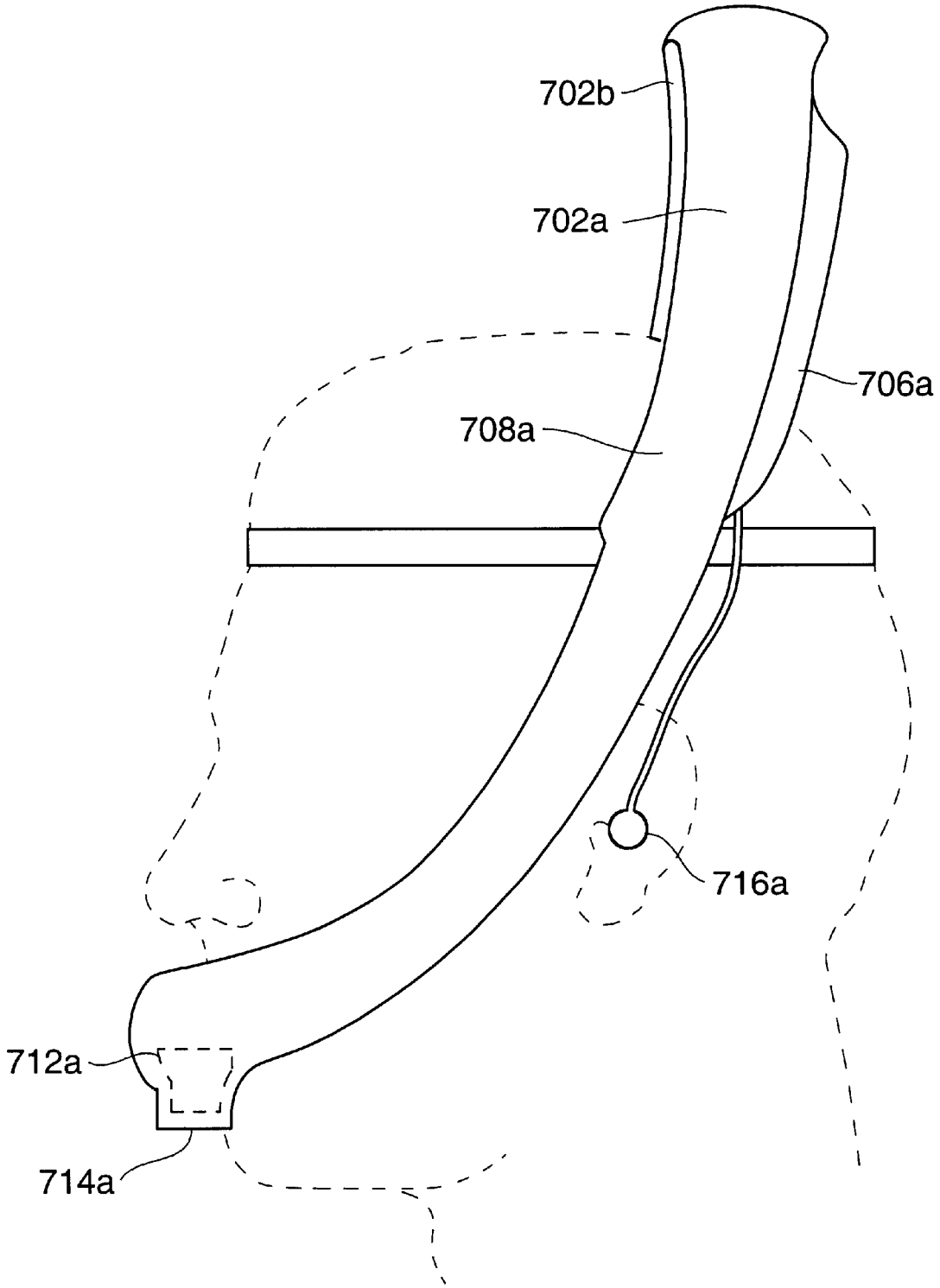

FIG. 7B shows a side view of snorkel 700, wherein waterproof radio 706*a* is positioned immediately above junction 708*a*. Waterproof radio 706*a* can include an AM/FM receiver and/or a receiver enabling the swimmer to receive communications from an instructor or coach via earpieces 716*a* and 716*b*. Housing 706*b* on the second breathing tube 702*b* (corresponding to the location of radio 706*a* on first breathing tube 702*a*) could store additional batteries for radio 706*a*, allowing for longer periods of use.

In conclusion, the various embodiments of the present invention should generally be viewed as being complementary rather than exclusive. Thus, a snorkel in accordance with the present invention could be fabricated combining some or all of the features described.

For example, a snorkel in accordance with the present invention that includes a half-circle and airfoil cross-sections could, but would not be required to also include the curved upper breathing tube portion disposing the upper opening toward the lower portion.

Similarly, a snorkel having a single breathing tube could be adapted to contain a waterproof radio including a single earpiece, or a snorkel having a single breathing tube could be equipped with a dual chamber drainage area.

Therefore, it is intended that the following claims define the scope of the present invention, and that the methods and structures within the scope of these claims and their equivalents be covered hereby.

What is claimed is:

1. An apparatus including a breathing tube allowing a user to breathe while swimming comprising:

a lower breathing tube portion having a substantially half-circular cross-section and including a mouthpiece open to a breathing chamber, and a purge valve permitting one-way flow of air and water out of the breathing tube, and an upper breathing tube portion joined to the lower portion at a junction and including a check valve operable from an inactivated state permitting free movement of air to an activated state preventing movement of air into and out of the check valve, and an upper opening, the check valve biased in the inactivated state and moveable to the activated state in response to forceful exhalation by a user into the mouthpiece.

2. The apparatus according to claim 1 further including a strap secured to the breathing tube with a loop positioned at the junction, the strap having ends fixed to a detachable clip.

3. The apparatus according to claim 1 wherein the upper portion further includes a straight segment above the junction and an arc segment above the straight segment, the arc segment changing direction 180° from the straight segment such that the upper opening faces the lower portion, the check valve located at a meeting of the straight segment and the arc segment.

4. The apparatus according to claim 1 wherein the purge valve includes a perforated cross-member traversing the breathing tube and fixed to a center portion of an umbrella flap, such that sharp exhalation by the swimmer causes peripheral edges of the umbrella flap to move away from the cross-member, allowing air to pass through the purge valve and out of the breathing tube.

5. An apparatus including a breathing tube allowing a user to breathe while swimming comprising:

a lower breathing tube portion having a substantially half-circular cross-section and including a mouthpiece open to a breathing chamber, and a purge valve permitting one-way flow of air and water out of the breathing tube and an upper breathing tube portion joined to the lower portion at a junction and including a check valve operable from an inactivated state permitting free movement of air to an activated state preventing movement of air into and out of the check valve, and an upper opening;

wherein the upper portion is formed from a rigid plastic material and the lower portion is formed from a flexible plastic shell supported by an internal wire.

6. An apparatus including a breathing tube allowing a user to breathe while swimming comprising:

a lower breathing tube portion having a substantially half-circular cross-section and including a mouthpiece open to a breathing chamber, and a purge valve permitting one-way flow of air and water out of the breathing tube, and an upper breathing tube portion joined to the lower portion at a junction and including a check valve operable from an inactivated state permitting free movement of air to an activated state preventing movement of air into and out of the check valve, and an upper opening;

wherein the check valve includes a flap having a first end and a second end, the first end fixed to a lip formed inside the breathing tube and the second end moveable to obstruct the breathing tube, the flap supported by an adjustment screw projecting a distance into the breathing tube such that varying the distance that the screw projects into the airway determines the force necessary to move the second end of the flap to obstruct the airway.

7. An apparatus including a breathing tube allowing a user to breathe while swimming comprising:

a lower breathing tube portion having a substantially half-circular cross-section and including a mouthpiece open to a breathing chamber, and a purge valve permitting one-way flow of air and water out of the breathing tube, and an upper breathing tube portion joined to the lower portion at a junction and including a check valve operable from an inactivated state permitting free movement of air to an activated state preventing movement of air into and out of the check valve, and an upper opening; and a radio located in a housing formed on the upper portion of the breathing tube.

8. An apparatus including a breathing tube allowing a user to breathe while swimming comprising:

a lower breathing tube portion having a substantially half-circular cross-section and including a mouthpiece open to a breathing chamber, and a purge valve permitting one-way flow of air and water out of the breathing tube, and an upper breathing tube portion joined to the lower portion at a junction and including a check valve operable from an inactivated state permitting free movement of air to an activated state preventing movement of air into and out of the check valve, and an upper opening; and a second breathing tube, the second breathing tube including a lower portion and an upper portion joined at a second junction, the lower portion of the second breathing tube connected to the lower portion of the first breathing tube and the upper portion of the second breathing tube connected to the upper portion of the first breathing tube, the lower portion of the second breathing tube including a second breathing chamber in communication with the mouthpiece and a second purge valve, the upper portion of the second breathing tube including a second check valve and the upper opening.

9. The apparatus according to claim 8 further including a radio located in a first housing formed on the upper portion of the first breathing tube and a radio power supply located in a second housing formed on the upper portion of the second breathing tube.

10. An apparatus including a breathing tube allowing a user to breathe while swimming comprising:

a lower breathing tube portion having a substantially half-circular cross-section including a straight edge and a curved edge, the lower portion including, a mouthpiece positioned in front of the straight edge and open to a breathing chamber, and a purge valve permitting one-way flow of air and water out of the breathing tube; and an upper breathing tube portion joined to a lower portion at a junction, the upper portion having an airfoil cross-section including sides and a leading tip and a trailing tip, the upper portion including, a check valve operable from an inactivated state permitting free movement of air to an activated state preventing movement of air into and out of the check valve, the check valve biased in the inactivated state and moveable to the activated state in response to forceful exhalation by a user into the mouthpiece, and an upper opening.

11. The apparatus according to claim 10 further including a strap secured to the breathing tube with a loop positioned at the junction, the strap having ends fixed to a detachable clip.

12. The apparatus according to claim 10 wherein the upper portion further includes a straight segment above the junction and an arc segment above the straight segment, the arc segment changing direction 180° from the straight segment such that the upper opening faces the lower portion, the check valve positioned at the top of the straight segment prior to the arc segment.

13. The apparatus according to claim 10 wherein the purge valve includes a perforated cross-member traversing the breathing tube and fixed to a center portion of an umbrella flap, such that sharp exhalation by the swimmer causes peripheral edges of the umbrella flap to move away from the cross-member, allowing air to pass through the purge valve and out of the breathing tube.

14. An apparatus including a breathing tube allowing a user to breathe while swimming comprising:

a lower breathing tube portion having a substantially half-circular cross-section including a straight edge and a curved edge, the lower portion including, a mouthpiece positioned in front of the straight edge and open to a breathing chamber, and a purge valve permitting one-way flow of air and water out of the breathing tube; and an upper breathing tube portion joined to a lower portion at a junction, the upper portion having an airfoil cross-section including sides and a leading tip and a trailing tip, the upper portion including, a check valve operable from an inactivated state permitting free movement of air to an activated state venting movement of air into and out of the check valve, and an upper opening;

wherein the upper portion is formed from a rigid plastic material and the lower portion is formed from a flexible plastic shell supported by an internal wire.

15. An apparatus including a breathing tube allowing a user to breathe while swimming comprising:

a lower breathing tube portion having a substantially half-circular cross-section including a straight edge and a curved edge, the lower portion including, a mouthpiece positioned in front of the straight edge and open to a breathing, chamber, and a purge valve permitting one-way flow of air and water out of the breathing tube; and an upper breathing tube portion joined to a lower portion at a junction, the upper portion having an airfoil cross-section including sides and a leading tip and a trailing tip, the upper portion including, a check valve operable from an inactivated state permitting free movement of air to an activated state preventing, movement of air into and out of the check valve wherein the check valve includes a flap having a first end and a second end, the first end fixed to a lip formed inside the breathing tube and the second end moveable to obstruct the breathing tube, the flap supported by an adjustment screw projecting a distance into the breathing tube, such that varying the distance that the screw projects into the breathing tube determines the force necessary to move the second end of the flap to completely obstruct the airway, and an upper opening.

16. An apparatus including a breathing tube allowing a user to breathe while swimming comprising:

a lower breathing tube portion having a substantially half-circular cross-section including a straight edge and a curved edge, the lower portion including, a mouthpiece positioned in front of the straight edge and open to a breathing chamber, and a purge valve permitting one-way flow of air and water out of the breathing tube; and an upper breathing tube portion joined to a lower portion at a junction, the upper portion having an airfoil cross-section including sides and a leading tip and a trailing tip, the upper portion including, a check valve operable from an inactivated state permitting free movement of air to an activated state preventing movement of air into and out of the check valve, and an upper opening;

a radio located in a housing formed on the upper portion of the breathing tube.

17. An apparatus including a breathing tube allowing a user to breathe while swimming comprising:

a lower breathing tube portion having a substantially half-circular cross-section including a straight edge and a curved edge, the lower portion including, a mouthpiece positioned in front of the straight edge and open to a breathing chamber, and a purge valve permitting one-way flow of air and water out of the breathing tube; and an upper breathing tube portion joined to a lower portion at a junction, the upper portion having an airfoil cross-section including sides and a leading tip and a trailing tip, the upper portion including, a check valve operable from an inactivated state permitting free movement of air to an activated state preventing movement of air into and out of the check valve, and an upper opening, a second breathing tube, the second breathing tube including a lower portion and an upper portion joined at a second junction, the lower portion of the second breathing tube connected to the lower portion of the first breathing tube and the upper portion of the second breathing tube connected to the upper portion of the first breathing tube, the lower portion of the second breathing tube including a second breathing chamber in communication with the mouthpiece and a second purge valve, the upper portion of the second breathing tube including a second check valve and the upper opening.

18. The apparatus according to claim 17 further including a radio located in a first housing formed on the upper portion of the first breathing tube and a radio power supply located in a second housing formed on the upper portion of the second breathing tube.

19. An apparatus including a breathing tube allowing a user to breathe while swimming comprising:

a lower breathing tube portion including a mouthpiece open to a breathing chamber, and a purge valve permitting one-way flow of air and water out of the breathing tube, and an upper breathing tube portion joined to the lower portion at a junction and including a check valve biased in an inactivated state permitting free movement of air through the check valve and being moveable to an activated state preventing movement of air into and out of the check valve, the check valve moveable from the inactive state to the activated state in response to forceful exhalation by a user into the mouthpiece.

* * * * *